US009259368B2

(12) United States Patent
Jensen et al.

(10) Patent No.: US 9,259,368 B2
(45) Date of Patent: Feb. 16, 2016

(54) PATIENT TRANSPORTER WITH SPONSONS

(71) Applicant: Paper-Pak Industries, Laverne, CA (US)

(72) Inventors: Ronald Jensen, Chicago, IL (US); Richard Beu, Yorba Linda, CA (US)

(73) Assignee: Paper-Pak Industries, Laverne, CA (US)

( * ) Notice: Subject to any disclaimer, the term of this patent is extended or adjusted under 35 U.S.C. 154(b) by 0 days.

(21) Appl. No.: 14/212,337

(22) Filed: Mar. 14, 2014

(65) Prior Publication Data

US 2014/0295721 A1 Oct. 2, 2014

Related U.S. Application Data

(60) Provisional application No. 61/801,077, filed on Mar. 15, 2013.

(51) Int. Cl.

| | |
|---|---|
| ***A61G 1/013*** | (2006.01) |
| ***B63C 9/04*** | (2006.01) |
| ***A61G 1/044*** | (2006.01) |
| ***A61G 1/048*** | (2006.01) |
| *A61G 7/057* | (2006.01) |
| *A61G 7/10* | (2006.01) |

(52) U.S. Cl.

CPC ..... *A61G 1/013* (2013.01); *A61G 1/044* (2013.01); *A61G 1/048* (2013.01); *B63C 9/04* (2013.01); *A61G 7/057* (2013.01); *A61G 7/1001* (2013.01); *A61G 7/1021* (2013.01); *A61G 2220/00* (2013.01); *B63C 2009/042* (2013.01); *B63C 2009/048* (2013.01)

(58) Field of Classification Search

CPC ..... A61G 1/00; A61G 1/013; B63C 9/04; B63C 9/00; B63C 9/08

USPC ..... 441/129, 128; 5/625, 626, 628

See application file for complete search history.

(56) References Cited

U.S. PATENT DOCUMENTS

| | | | | |
|---|---|---|---|---|
| 2,880,427 | A | 4/1959 | Atwood | |
| 3,449,776 | A | 6/1969 | Brock | |
| 4,067,075 | A * | 1/1978 | Leathers et al. | 5/625 |
| 4,466,145 | A * | 8/1984 | Jones et al. | 5/625 |
| 4,896,804 | A | 1/1990 | Dearborn et al. | |
| 5,070,647 | A | 12/1991 | Spialter | |
| 5,384,926 | A | 1/1995 | Al-Bargi | |

(Continued)

FOREIGN PATENT DOCUMENTS

WO 2013086540 A2 6/2013

OTHER PUBLICATIONS

International Preliminary Report on Patentability dated Mar. 28, 2014 for PCT application No. PCT/US2012/068838.

(Continued)

*Primary Examiner* — Lars A Olson

(74) *Attorney, Agent, or Firm* — Ohlandt, Greeley, Ruggiero & Perle, LLP

(57) ABSTRACT

A patient transporter having sponsons that provide buoyancy when deployed on water is provided. A sponson assembly formed by two sponsons connected to each other by a material, and which can be positioned beneath a patient transporter to provide buoyancy, is also provided.

11 Claims, 2 Drawing Sheets

(56) References Cited

U.S. PATENT DOCUMENTS

| | | | | |
|---|---|---|---|---|
| 5,421,757 | A * | 6/1995 | Basiliere | B63C 9/04 441/128 |
| 6,715,170 | B2 * | 4/2004 | Richmond | 5/625 |
| 2009/0173255 | A1 | 7/2009 | Zhang | |
| 2010/0199435 | A1 | 8/2010 | Jensen et al. | |

OTHER PUBLICATIONS

International Search Report dated Feb. 22, 2013 for PCT application No. PCT/US2012/068838.

Written Opinion dated Feb. 22, 2013 for PCT application No. PCT/US2012/068838.

* cited by examiner

PATIENT TRANSPORTER WITH SPONSONS

CROSS-REFERENCE TO RELATED APPLICATIONS

This application claims the benefit of U.S. Provisional Application No. 61/801,077, filed on Mar. 15, 2013.

BACKGROUND OF THE DISCLOSURE

1. Field of the Disclosure

The present disclosure relates to a patient transporter having sponsons to provide buoyancy.

2. Description of Related Art

One difficulty with a patient transporter, also called litter or stretcher, is that the transporters are not adapted for transporting the patient over lakes, rivers, streams, and other water tributaries. When carrying an injured person on a patient transporter across a tributary of water, the injured person and transporter must be physically carried by two or more personnel who are themselves attempting to navigate across the tributary. Also, in those instances where an injured person is carried on a patient transporter across a water tributary, the water can rise onto the transporter, or worse, can completely submerge the transporter and expose the person to further injury or even drowning.

SUMMARY OF THE DISCLOSURE

The present disclosure provides a patient transporter having one or more sponsons to provide buoyancy when carrying a person on the patient transporter across water.

The present disclosure also provides a patient transporter having one or more sponsons that are uninflated prior to use, but are readily inflatable when needed for buoyancy.

The present disclosure still further provides a patient transporter having sponsons that, when inflated, block water from rising onto the patient transporter or contacting the person being carried thereon.

The present disclosure yet further provides a patient transporter having sponsons that can act as a wave-break when transporting a patient over moving water, such as a river.

DETAILED DESCRIPTION OF THE DISCLOSURE

Figure 1:
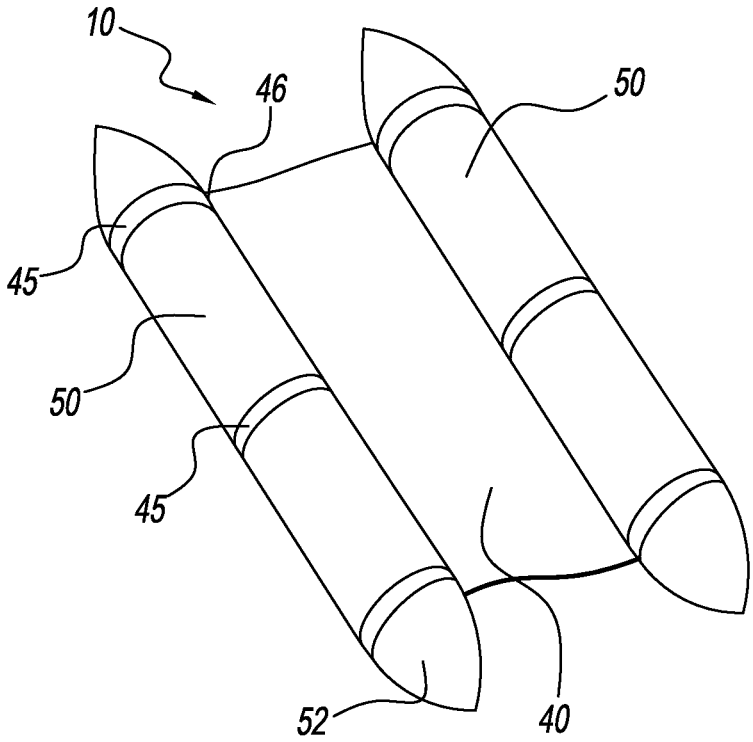
FIG. 1 is a perspective view of a first embodiment of a sponsons assembly of the present disclosure.
Figure 2:
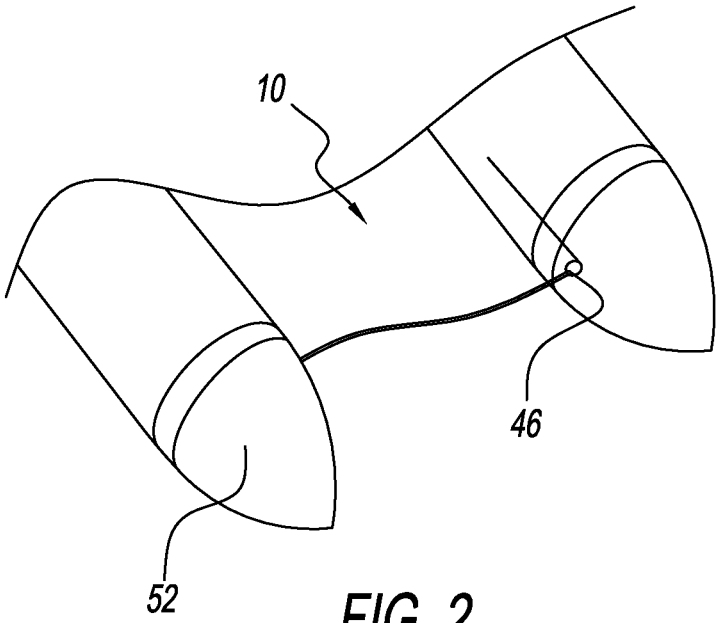
FIG. 2 is an enlarged view of the end of a sponsons assembly of FIG. 1.
Figure 3:
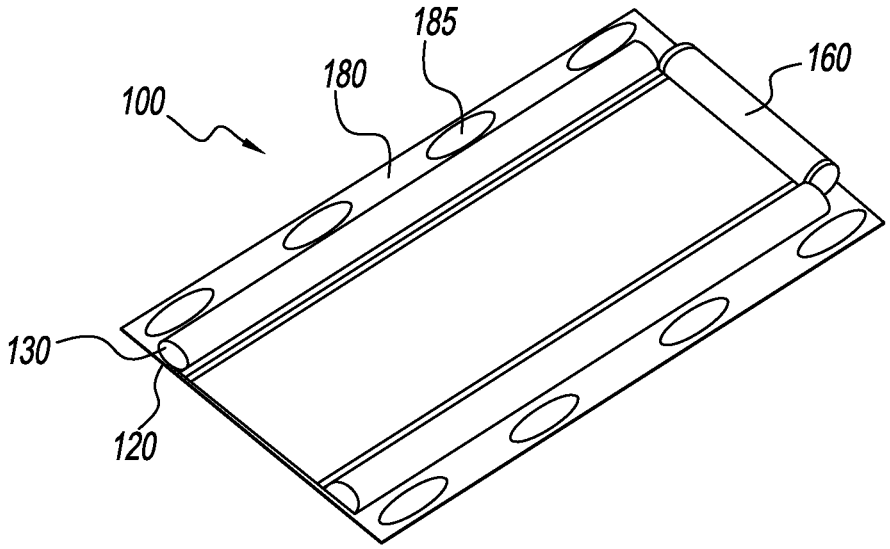
FIG. 3 is a perspective view of another embodiment of the present disclosure, in which a patient transporter has inflatable sponsons.

Referring to the drawings, and, in particular, FIGS. 1 to 3, there is provided a sponson assembly generally represented by reference numeral 10. Sponson assembly 10 has two sponsons 50, and has a material 40 therebetween.

"Sponson" is defined herein as a buoyant appendage that is connected to soft goods, such as a patient transporter that is used for transporting an injured person.

Sponson(s) 50 can be used to provide buoyancy, resist capsizing, and as a wave-break that provide flotation capabilities to a transporter being moved across a water surface, increasing patient safety and reducing exertions of the one or more persons who are carrying the injured person on the patient transporter. Each sponson 50 can also be a structural barrier that reduces or prevents water from coming over the sides of the patient transporter and contacting the person being carried.

In an embodiment of the present disclosure, a patient transporter having one or more sponson(s) 50 can carry a patient up to 350 pounds.

In an embodiment of the present disclosure, each sponson 50 can be approximately 6 feet to 8 feet in length, with about a 16 inch (16") diameter (cylinder diameter). The total length of each sponson 50 can be entirely within the footprint of the patient transporter, or a portion of sponson 50 can extend beyond the head and/or foot ends of the patient transporter 100.

FIG. 1 shows an embodiment in which sponsons 50 are connected by one or more pieces of material 40. Material 40 is preferably a textile material.

Each sponson 50 can be individually or simultaneously inflated. A patient transporter can be connected to, or simply placed on top of, material 40, so that the transporter is stably positioned between sponsons 50.

As shown in FIG. 2, each sponson 50 is an inflatable structure. Such structures include, but are not limited to, a bag or air bladder. Each sponson 50 can be inflated by any means, including, but not limited to, by mouth, foot pump, and ambi-bag. Preferably, each sponson 50 is elongated when inflated so that each sponson 50 can be positioned and orientated along a longitudinal extent of the patient transporter.

FIGS. 1 and 2 show an embodiment of the present disclosure in which each sponson 50 comes to a conical point 52, 54 at the front and back ends of sponson 50, respectively, when inflated. Conical points 52, 54 (and the overall shape and configuration of sponson 50) assist with cutting the water surface when transporter 100 with sponsons 50 attached thereto is floated on the surface of the water. Points 52, 54 make it easier to move and maneuver the transporter with sponsons 50 through the water.

Material 40 is connected to each sponson 50 by a fastener, such as connection band 45. Other fasteners that can be used to connect sponson 50 to material 40, include, but are not limited to, strap, clip, tie-down, and d-clip.

FIG. 2 shows a portion of sponson assembly 10 in which material 40 has a reinforced slot that allows connection band 45 to pass through at a connection point 46. Connection band 45 can be held securely in position on material 40 by a stop (not shown). In an embodiment, each of the two longitudinal sides of material 40 are attached to sponson 50 by two or more connection bands 45 around each sponson 50, where connection band 45 and material 40 are connected at a connection point 46.

In another embodiment, sponsons 50 and material 40 can have a cover that makes them a single piece.

Material 40 is preferably a textile material, including, but not limited to, an open cell material (such as a mesh) or a closed cell material (such as a cloth). To ensure that material 40 can support the weight of a patient transporter and a person being carried thereon, material 40 has a tensile strength greater than 500 lbs.

In another embodiment, each sponson 50 is a separate inflatable structure that is not directly connected by material 40 to another sponson 50, but rather each sponson 50 is directly attached to a soft goods portion of patient transporter 100.

An example of a patient transporter that can include sponsons includes, but is not limited to, a patient transporter with an expandable, deployable support structure described in copending International Application No. PCT/US12/68838, titled "Patient Transporter With Expandable/Deployable Support Structure," published as International Publication No. 2013/086540 A2, which is incorporated by reference herein.

As discussed above, a patient transporter can be placed on material 40 between the two sponsons 50 so that the entire structure can float, or alternatively, provides buoyancy that allows the structure to be moved across a body of water. The patient transporter placed on material 40 is suspended between two sponsons 50, and can be affixed to sponsons assembly 10 either by straps, d-clips, and tie downs, although other fasteners may be used.

A consideration of the designs of the present disclosure is a balancing of buoyancy and displacement. While it is much easier to inflate an air bladder structure to provide buoyancy than to provide rigidity, it is important to balance the considerations of buoyancy and displacement in the selection of sponsons.

Displacement is the pushing away of a fluid when an object is immersed in it. While not limiting the present disclosure to this theory, if a system is considered that will hold 500 lbs. of weight, and the overall weight of the system is desired to be 20 lbs., then this implies (in accordance with Archimedes' principle that "an object partially or wholly immersed in a fluid is buoyed up by a force equal to the weight of the fluid displaced by the object"), using rough calculations, the desired structure would need to support 1040 lbs. (i.e., 2 times the weight, plus the system) to have sponsons 50 half-submerged. Based on water (sea water) having an approximate density of about 64 lbs./cubic feet, then about 16.25 cubic feet of volume is needed to support this weight. Thus, with two (2) sponsons 50, each sponson 50 should be about 8.125 cubic feet. However, sponsons 50 of FIGS. 1 and 2 and chambers 130 of FIG. 3, discussed below, can likely be smaller, or have a different configuration, since the present device can also have an inflatable head support 160. Thus, it is envisioned that, in either of the above embodiments, the transporter and sponson assembly 50 of the embodiment in FIG. 1, or the transporter 100 embodiment of FIG. 3, the total weight is about 9 lbs. This weight is believed to be less than one-half of the normal total transporter weight that is about 19.5 lbs.

Further, since sponsons 50 are affixed to soft goods, namely, material 40, at strategic points, the rigid structure placed thereon stays on top of the water. Significantly, sponsons 50 are placed outboard, i.e., along the sides of the transporter and/or the pad. Sponsons 50 also serve an important function as a wave-break to enhance the well-being and safety of the patient being carried, since even with a degree of buoyancy, there would still be a risk of adverse effects or even drowning if the water were to rise over the top of the transporter and the patient.

Sponsons 50 need to provide sufficient buoyancy to keep the entire transporter and the patient above the water line. Preferably, sponsons 50 provide sufficient buoyancy that only the bottom surface of sponsons 50 contact the water surface, such that even textile material 40 is above the water line. If transporter 100 includes a rigid support structure, as in the example above, the rigid support structure reduces or prevents any sagging of the transporter between sponsons 50, even with the full weight of the person (and the patient's center of gravity) positioned between sponsons 50.

Referring to FIG. 3, there is shown a second embodiment of the present disclosure. This second embodiment is transporter 100 having an integral flotation structure. Transporter 100 has at least a pair of channels or tubes 120 formed into the bottom structure/surface 180 of the transporter. Channels 120 would be positioned that they are outboard of the rigid frame assembly, but within the total pad structure (and on the inner side of handles 185). The channels/tubes 120 would run along the side and axial extent of the transporter and at the head area. In this embodiment, chambers 130 are positioned in channels 120. Chambers 130 are inflatable structures, such as, for example, inflatable tubes or inflatable bladders that, once inflated, allow transporter 100 to float on water. In another embodiment of the present disclosure, one or more of channels 120 are inflatable in themselves. Channels 120 and internal chambers 130 can be separate structures, or can form a single, integral structure.

Chambers 130 can be inflated by any common means including, but not limited to, by mouth, foot pump, and ambi-bag.

Chambers 130 can have an openable sealing element connected to one sealable end. The openable sealing element is normally a valve element that allows flow in one direction to help prevent leakage of the gas/air.

The material for sponsons 50 of FIG. 1 or chambers 130 of FIG. 3 can include, but is not limited to, a heat sealable polymer-based material, or materials with similar properties. Materials that can be used to make sponsons 50, and perhaps chambers 130, include, but are not limited to, urethane coated fabrics, HYPALON (chlorosulfonated polyethylene (CSPE), synthetic rubber (CSM)) fabrics, neoprene base fabrics, and other similar materials.

Sponsons 50 and chambers 130 require appropriate sizing and volumetric area to allow them to support the weight of the rigid litter and the patient thereon, and to maintain the required buoyancy while transporting the patient on water. Buoyancy is an upward force on an object immersed in a fluid. In addition, each chamber 130 is internal to each channel 120 so that channel 120 must have a large enough diameter to permit for this inflation of chamber 130.

Referring to the embodiment of FIGS. 1 and 2, sponsons 50 could have external handles to allow the other support personnel to hold on to the transporter 100 while swimming, or could have a tether rope along its sides, or even a drag strap to help move the sponsons through the water. The handles 185 of transporter 100 of FIG. 3, or a transporter for use with the embodiment in FIGS. 1 and 2, can be used by support swimmers to maneuver the assembly down the river. A further option, such as a tether line or a pull cord, could easily be used as well.

The structure of either embodiment provides for the transporter assembly to be a kit that enables on, such as, for example, special forces personnel in a war area to move rapidly and for longer periods of time, even in mountain areas or in extreme cold, due to the significantly reduced weight of the present assemblies.

As used in this application, the word "about" for dimensions, weights, and other measures means a range that is ±10% of the stated value, more preferably ±5% of the stated value, and most preferably ±1% of the stated value, including all subranges therebetween.

It should be understood that the foregoing description is only illustrative of the present disclosure. Various alternatives and modifications can be devised by those skilled in the art without departing from the present disclosure. Accordingly, the present disclosure is intended to embrace all such alternatives, modifications, and variances that fall within the scope of the present disclosure.

What is claimed is:

1. A sponson assembly for a patient transporter, the sponson assembly comprising:

a sponson comprising a middle portion and an end portion, the middle portion having a cylindrical shape, the end portion having a conically shaped point for cutting a water surface when the patient transporter is floated on the water surface; and a material directly connected to the sponson, wherein the material positions the patient transporter on the sponson, wherein the material is a textile material that is an open cell material or a closed cell material, wherein the sponson assembly is connected to the patient transporter and provides buoyancy when deployed on water.

2. The sponson assembly according to claim 1, wherein the sponson is inflatable.

3. The sponson assembly according to claim 2, wherein the sponson is an inflatable air bladder.

4. The sponson assembly according to claim 1, wherein the sponson is positioned along a longitudinal extent of the patient transporter.

5. The sponson assembly according to claim 1, wherein the sponson comprises two sponsons.

6. The sponson assembly according to claim 5, wherein the two sponsons are directly connected by the material positioned therebetween.

7. The patient transporter according to claim 5, wherein the two sponsons are positioned outboard along sides of the patient transporter.

8. The patient transporter according to claim 5, wherein the two sponsons provide a wave-break that reduces overflow of water onto the patient transporter when deployed on water.

9. The sponson assembly according to claim 1, wherein the material is a mesh.

10. The sponson assembly according to claim 1, wherein the material is a cloth.

11. A patient transporter having a sponson assembly, comprising:

a patient transporter, the patient transporter comprising a first portion and a second portion, wherein the second portion is less rigid than the first portion;

two or more channels formed into the patient transporter, wherein the two or more channels are outboard of the first portion and are positioned axially along sides of the patient transporter; and two or more inflatable chambers, each inflatable chamber positioned in a separate one of each of the two or more channels to provide buoyancy to the patient transporter when deployed in water.

* * * * *